US005096040A

United States Patent [19]

Wente et al.

[11] Patent Number: 5,096,040

[45] Date of Patent: Mar. 17, 1992

[54] DETECTION OF MISSING STEPS IN AN ESCALATOR OR MOVING WALK

[75] Inventors: Gerald Wente, Pohle; Matthias Steffen, Kirchbrak, both of Fed. Rep. of Germany

[73] Assignee: Otis Elevator Company, Farmington, Conn.

[21] Appl. No.: 764,877

[22] Filed: Sep. 24, 1991

[51] Int. Cl.[5] ..... B66B 9/12

[52] U.S. Cl. ..... 198/323

[58] Field of Search ..... 198/323

[56] References Cited

FOREIGN PATENT DOCUMENTS 0307557 6/1988 European Pat. Off. .
082074 6/1983 France .
0016290 2/1978 Japan ..... 198/323
53-140788 8/1978 Japan .
0844537 7/1981 U.S.S.R. ..... 198/323
850541 7/1981 U.S.S.R. .

*Primary Examiner*—D. Glenn Dayoan
*Attorney, Agent, or Firm*—William W. Jones

[57] ABSTRACT

A mechanical sensor is placed beside the return run of the steps on an escalator or moving walk, The sensor is biased toward the steps so as to bear against each step passing thereby. If a step in the series is missing from its normal position, the sensor will move in the direction of the step run and will open a switch in the escalator power circuit thereby shutting off power to the escalator. The switch can only be manually reset by a mechanic from a location which is closed off to the public.

5 Claims, 2 Drawing Sheets

2
4
6
8
10
12
14
16
18
20
22
24
26
28
30
32
34
36
38
46

DETECTION OF MISSING STEPS IN AN ESCALATOR OR MOVING WALK

TECHNICAL FIELD

This invention relates to the detection of missing steps on a people conveyor, and the shutting off of power to the conveyor once a missing step is detected.

BACKGROUND ART

People conveyors such as escalators or moving walkways which are formed from a series of adjacent moving steps generally include a passenger carrying path of travel which begins and ends at opposed landings, and a return path of travel which is disposed beneath the passenger carrying path of travel, and out of sight of persons using the conveyor. At each landing are disposed step reversal sprockets which engage step chains and guide the step chains and steps through a 180° arc to reverse the direction of movement of the steps. As the steps pass over the sprockets, the steps invert and reinvert their spacial orientation. With extensive usage and equipment aging, the possibility arises that a step may break loose from the step chain. A number of failures can produce this result. If a step should thus break loose, it will swing by gravity away from its normal path of travel, and the step tread will fall downwardly. When the steps are properly connected together on the step chain, there will be a constant procession of steps past any given point along the path of travel, and there will not exist any significant gaps in the step procession. When a step breaks loose, however, a significant gap will be created in the procession of steps. When a step breaks loose, the conveyor drive may continue to operate so that one using the conveyor would not know that a step is missing, or out of place. This can result in injury to passengers when the displaced step returns to the passenger carrying path of travel.

The problem of detecting abnormally positioned passenger conveyor steps has been addressed in the prior art. Japanese Kokai No. 53-140788 discloses a system for detecting abnormal step roller wear in a passenger conveyor which will result in misalignment of the steps. French Patent No. 082,074 discloses a control device including a proximity sensor for detecting recessed defects in the surface of a continuous conveyor. Russian Patent No. 850,541 discloses a monitor for an escalator for detecting the presence or absence of the escalator step rollers to detect detached escalator steps, should one occur. European Patent Publication No. 0,307,557 discloses an escalator step monitor which uses photoelectric detectors below the steps to detect the dropping of a step.

DISCLOSURE OF THE INVENTION

This invention relates to a simplified mechanical system for determining whether the steps on an escalator or moving walk are in their proper positions in the return run of the conveyor. The system of this invention includes a contact roller mounted on a movable spring biased carriage disposed to one side of the return path of travel of the steps beneath both of the landings of the escalator. The spring bias urges the carriage toward one side of the steps to force the contact roller against the side of each step as the steps pass by the detector. The carriage also includes a camming surface which is positioned adjacent to a power interruption switch button tied into the main power circuit for the escalator. So long as the steps are in their proper positions, the contact roller will hold the carriage camming surface away from the switch, and the escalator will continue normal operation. If one of the steps is misplaced, the contact roller will be pushed into the space normally occupied by the missing step, and the carriage will move so as to drive the camming surface across the switch button causing the latter to open the main power circuit thereby interrupting power to the escalator drive. This will shut the escalator off and sound an audible or visual alarm. The power switch can only be reset from a remote location beneath the landing after the defect has been corrected.

It is therefore an object of this invention to provide an escalator step detector which identifies missing steps in the escalator's return run.

It is a further object of this invention to provide a step detector of the character described which involves direct step contact in its mode of operation.

It is an additional object of this invention to provide a step detector of the character described which turns the escalator off in the event of a missing step.

These and other objects and advantages of the invention will become more readily apparent from the following detailed description of a preferred embodiment of the invention when taken in conjunction with the accompanying drawings, in which:

BEST MODE FOR CARRYING OUT THE INVENTION

Figures 1, 2, 3:
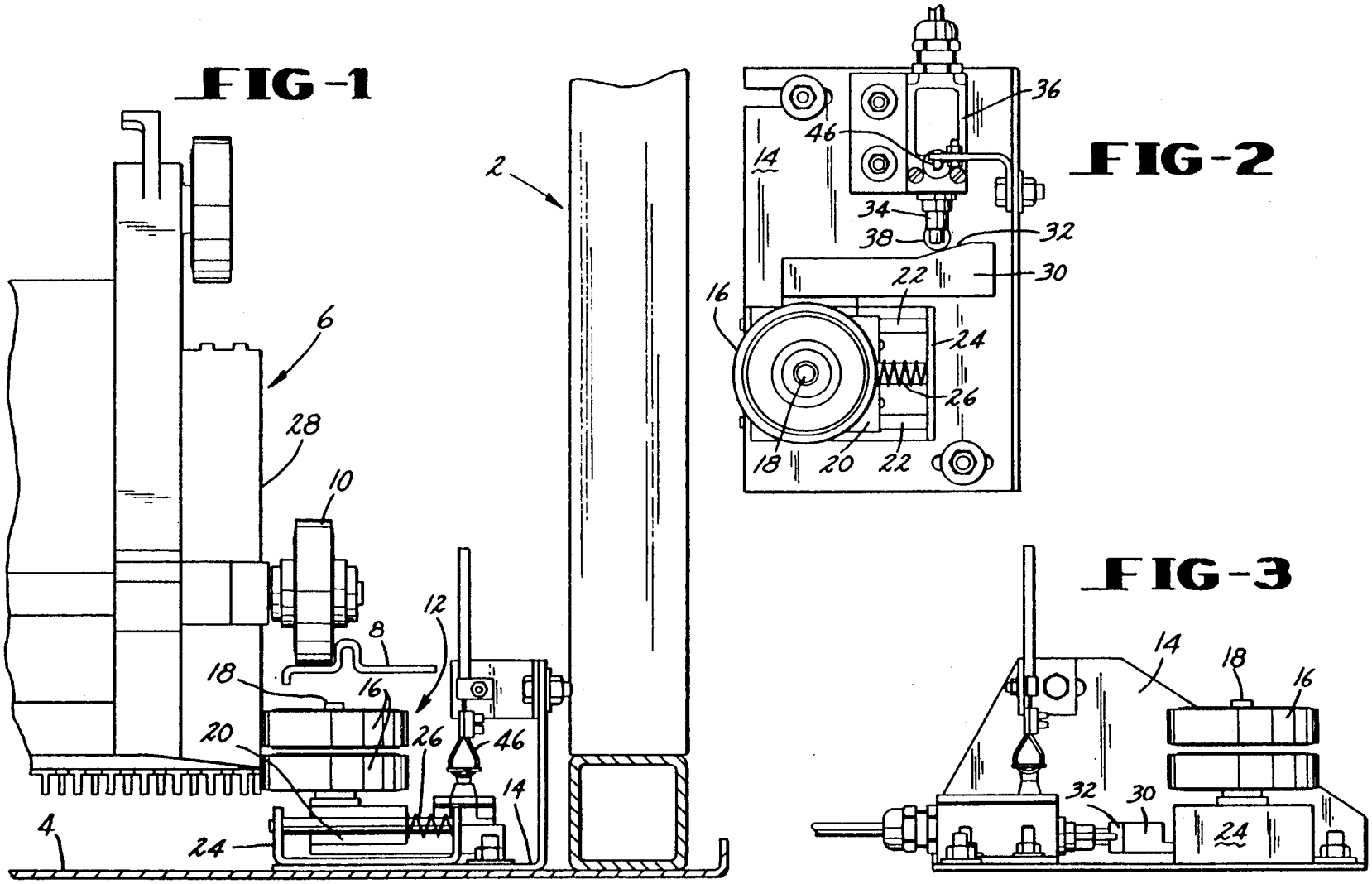
FIG. 1 is a fragmented front elevational view partially in section of a preferred embodiment of the step detector of this invention.
FIG. 2 is a top plan view of the step detector of FIG. 1.
FIG. 3 is a side elevational view taken from the left hand side of FIG. 1.

Referring now to the drawings, there is shown in FIGS. 1-3 a preferred embodiment of a step detector formed in accordance with this invention. The escalator includes a truss 2 on which a pan 4 is mounted. The steps 6 move on a track 8 via rollers 10 as they return from the exit landing to the entrance landing on the escalator. The step detector is denominated generally by the numeral 12, and is carried on a mount bracket 14 secured to the pan 4. The detector 12 includes a pair of contact rollers 16 journaled on a shaft 18 which is mounted on a slidable carriage 20. The carriage 20 is slidable on a pair of rods 22 disposed on a U-shaped bracket 24 secured to the mount bracket 14. A spring 26 biases the carriage 20, and thus the rollers 16 toward the escalator steps 6. The rollers 16 will thus normally engage a side surface 28 on the escalator steps 6 as the latter move along their return path of travel.

The carriage 20 has a camming member 30 mounted on one side thereof. The camming member 30 includes an outboard cam ramp 32 thereon. A switch button 34 is mounted in a housing 36 secured to the mount bracket 14. The button 34 carries a rotatable wheel 38 which lies in the path of movement of the cam ramp 36, as is best shown in FIG. 2. The normal engagement between the contact rollers 16 and the side 28 of the steps 6 compresses the spring 26 and holds the cam ramp 36 away from the switch button wheel 38. The power switch thus remains closed and the escalator continues to run in a normal manner.

Figure 4:
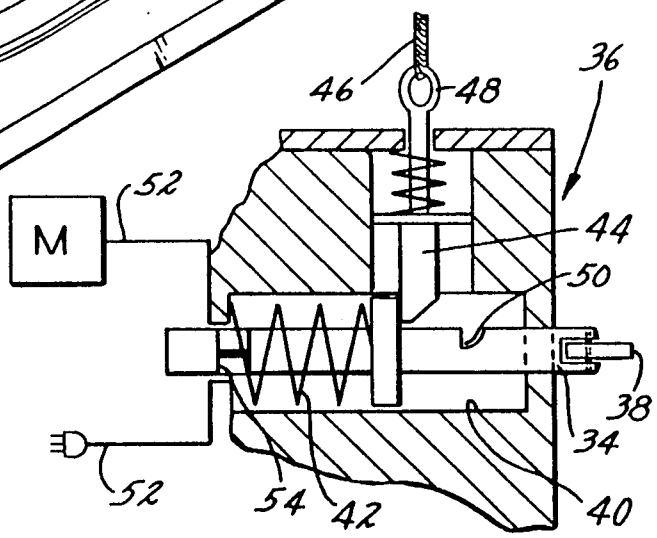
FIG. 4 is a fragmented cross-sectional view of the power control switch button used in the detector.

FIG. 4 shows details of the nature of the switch used to interrupt escalator power if a step is missing. The switch button 34 is mounted in a passage 40 in the housing 36 and is biased by a spring 42 to a power-on position shown in FIG. 4. A switch button detent 44 is biased by a spring 46 toward the button 34. The detent 44 has a pull cable 46 attached to an eyelet 48 on the detent 44. A detent notch 50 is formed on the button 34. Power lines 52 for electrical power to the escalator are connected by a contact 54 mounted on the button 34. When the switch mechanism components are in the respective positions shown in FIG. 4, power to the escalator is assured. In the event that the carriage 20 moves toward the steps 6 due to detection of a missing step, the cam ramp 32 will be moved against the wheel 38 causing the button 34 to move to the left as viewed in FIG. 4 compressing the spring 42 and moving the notch 50 into alignment with the detent 44. The aforesaid button movement causes the contact 54 to move out of engagement with the power lines. 52 thereby interrupting the flow of electricity to the escalator motor M. Additionally, the detent 44 will move into the notch 50 under the influence of the spring 46. The button 34, once pressed, will thus remain in a retracted power-off position regardless of subsequent movement of the carriage 20 and cam ramp 32.

Figure 5:
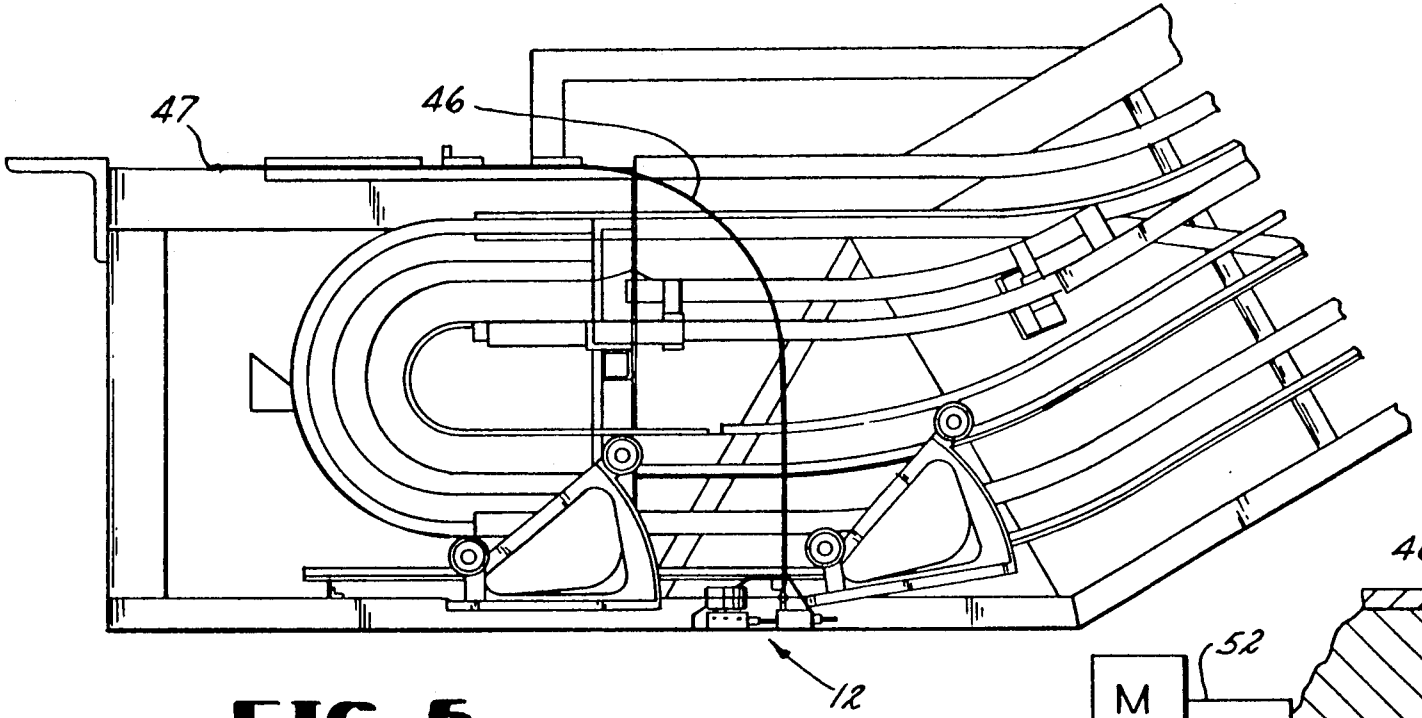
FIG. 5 is a fragmented side elevational view, with parts removed for clarity of a landing area of an escalator showing the location of one of the detectors, and the restart mechanism.

Once the problem has been repaired, the escalator is restarted by pulling the cable 46 by means of a loop 47 on an end thereof remote from the detector 12 as seen in FIG. 5. This ensures that the area under the landing can be cleared before the escalator is restarted. It will be appreciated that the step detector of this invention will detect missing steps, or displaced steps, under both landings on the escalator during the return run of the steps. Power to the escalator is substantially immediately interrupted and an audible alarm may be sounded so as to stop movement of the escalator and provides an alert when a missing step is sensed. The possibility of a passenger stepping into an empty space where a step should be is thus prevented, and the building superintendents are immediately alerted to the problem. The detector has a relatively simple construction, with few moving parts, and can be made from standard components. It is relatively impervious to dirt and other contaminants such as grease, oil, or other materials used to service and maintain escalators. Since many changes and variations of the disclosed embodiment of the invention may be made without departing from the inventive concept, it is not intended to limit the invention otherwise than as required by the appended claims.

What is claimed is:

1. A missing step detection assembly for use in an escalator or moving walk conveyor, said assembly comprising:

a) a movable carriage mounted below at least one landing of the conveyor, said carriage being disposed to one side of the return path of travel of the conveyor steps;

b) spring means for biasing said carriage toward said return path of travel;

c) contact roller means mounted on said carriage and operable to establish rolling contact with side surfaces of steps moving along the return path of travel, said roller means when contacting steps, being operable to compress said spring means;

d) contact switch means disposed to one side of said carriage, said switch means normally being closed to enable power to be supplied to operate the conveyor; and e) switch disabling means mounted on said carriage on a side of said switch means away from said return path of travel, said switch disabling means being normally spaced apart from said contact switch means and the side surfaces of the steps, and said switch disabling means, when moved to a position closer to said return path of travel as the result of said contact roller failing to contact a step, being operable to contact said contact switch means to open the latter to interrupt power supplied to the conveyor.

2. The assembly of claim 1 further comprising reset means for resetting said contact switch means to its closed condition after repairing the conveyor.

3. The assembly of claim 1 wherein said disabling means is a cam member mounted on said carriage and operable to selectively engage said switch means when said carriage moves toward said return path of travel.

4. The assembly of claim 3 wherein said switch means includes a switch button carrying a roller disposed in the path of travel of said cam member for selective contact with the latter.

5. The assembly of claim 2 wherein said reset means comprises a pull wire connected to said switch means and disposed at a location below said landing remote from said carriage whereby said conveyor can be restarted from a location remote from said return path of travel.

* * * * *